US009836074B2

(12) United States Patent
Choi

(10) Patent No.: US 9,836,074 B2
(45) Date of Patent: Dec. 5, 2017

(54) CURRENT GENERATION CIRCUITS AND SEMICONDUCTOR DEVICES INCLUDING THE SAME

(71) Applicant: SK hynix Inc., Icheon-si, Gyeonggi-do (KR)

(72) Inventor: Hae Rang Choi, Seoul (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 511 days.

(21) Appl. No.: 14/446,039

(22) Filed: Jul. 29, 2014

(65) Prior Publication Data

US 2015/0236579 A1 Aug. 20, 2015

(30) Foreign Application Priority Data

Feb. 20, 2014 (KR) ..... 10-2014-0019709

(51) Int. Cl.
*G05F 3/04* (2006.01)
*G05F 3/26* (2006.01)

(52) U.S. Cl.
CPC ..... *G05F 3/262* (2013.01)

(58) Field of Classification Search
CPC ..... G05F 3/10; G05F 3/16; G05F 3/20; G05F 3/26
USPC ..... 323/312
See application file for complete search history.

(56) References Cited

U.S. PATENT DOCUMENTS

2009/0302824 A1* 12/2009 Kim ..... G05F 3/24 323/313
2011/0234298 A1 9/2011 Suzuki
2013/0181762 A1* 7/2013 Wu ..... H03K 3/35613 327/333

* cited by examiner

*Primary Examiner* — Adolf Berhane
*Assistant Examiner* — Afework Demisse
(74) *Attorney, Agent, or Firm* — William Park & Associates Ltd.

(57) ABSTRACT

Semiconductor devices are provided. The semiconductor device may include a current generation circuit and an internal circuit. The current generation circuit may include a first drive element and a second drive element which are connected in series. The current generation circuit may generate a reference voltage signal whose voltage level is set by a reference current which is identical or substantially identical to a current flowing through the first and second drive elements. The internal circuit may utilize an output current controlled according to the reference current as an operation current thereof.

11 Claims, 3 Drawing Sheets

CURRENT GENERATION CIRCUITS AND SEMICONDUCTOR DEVICES INCLUDING THE SAME

CROSS-REFERENCE TO RELATED APPLICATION

The present application claims priority under 35 U.S.C 119(a) to Korean Application No. 10-2014-0019709, filed on Feb. 20, 2014, in the Korean Intellectual Property Office, which is incorporated herein by reference in its entirety as set forth in full.

BACKGROUND

1. Technical Field

Embodiments of the present disclosure generally relate to semiconductor integrated circuits and, more particularly, to current generation circuits and semiconductor devices including the same.

2. Related Art

In general, a current mirror circuit generating a constant current used in semiconductor devices may include a pair of active elements that provide two current paths. The current mirror circuit is designed such that the current flowing through one of the pair of active elements is identical to the current flowing through the other pair of active elements.

The pair of active elements constituting the current mirror circuit may use a pair of bipolar transistors or a pair of MOS transistors. In the event that the pair of active elements are using a pair of MOS transistors designed to be symmetric, a same bias voltage may be applied to gates of the pair of MOS transistors. In such cases, if a reference current is forced into one of the pair of MOS transistors, the same output current as the reference current may flow through the other of the pair of MOS transistors.

However, if drain currents of the pair of symmetric MOS transistors vary according to the variations in process/voltage/temperature (PVT) conditions, the output current may differ from the reference current causing the semiconductor devices to malfunction.

SUMMARY

According to various embodiments, a current generation circuit may include a reference voltage generator and an output current generator. The reference voltage generator may include a first drive element and a second drive element which are connected in series. The reference voltage generator may generate a reference voltage signal whose voltage level is set by a reference current which is identical or substantially identical to a current flowing through the first and second drive elements. The output current generator may generate an output current whose current level is set in response to the reference voltage signal. A threshold voltage of the first drive element is different from a threshold voltage of the second drive element.

According to various embodiments, a semiconductor device may include a current generation circuit and an internal circuit. The current generation circuit may include a first drive element and a second drive element which are connected in series. The current generation circuit may generate a reference voltage signal whose voltage level is set by a reference current which is identical or substantially identical to a current flowing through the first and second drive elements. The internal circuit may utilize an output current controlled according to the reference current as an operation current thereof. A threshold voltage of the first drive element is different from a threshold voltage of the second drive element.

According to various embodiments, a semiconductor device may include a current generation circuit and an internal circuit. The current generation circuit may include a resistive element and a first drive element which are connected in series. The current generation circuit may generate a reference voltage signal whose voltage level is set by a reference current which is identical or substantially identical to a current flowing through the resistive element and the first drive element. The internal circuit may utilize an output current controlled according to the reference current as an operation current thereof. A resistance value of the resistive element is different from a resistance value of the first drive element.

DETAILED DESCRIPTION

Various embodiments will be described hereinafter with reference to the accompanying drawings. However, the embodiments described herein are for illustrative purposes only and are not intended to limit the scope of the embodiments.

Figure 1:
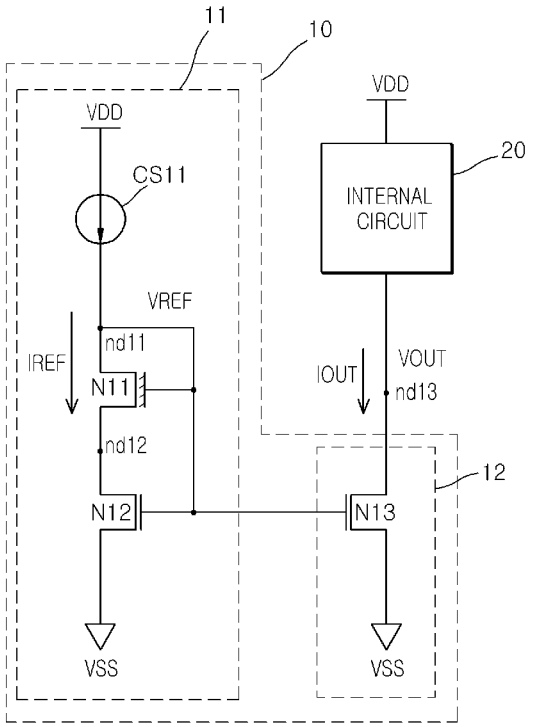
FIG. 1 is a schematic view illustrating a representation of a semiconductor device according to an embodiment.

Referring to FIG. 1, a semiconductor device according to an embodiment may be configured to include a current generation circuit 10 and an internal circuit 20.

The current generation circuit 10 may include a reference voltage generator 11 and an output current generator 12.

The reference voltage generator 11 may include a constant current source CS11. The constant current source CS11 may be coupled between a power supply voltage VDD terminal and a node ND11. A reference voltage signal VREF may be outputted through the node ND11. A first drive element N11 may be coupled between the node ND11 and a node ND12. A second drive element N12 may be coupled between the node ND12 and a ground voltage VSS terminal. The constant current source CS11 may supply a reference current IREF to the first drive element N11 through the node ND11. The first drive element N11 may include an NMOS transistor. In an embodiment, a drain of the first drive element N11 may be connected to the node ND11 and a source of the first drive element N11 may be connected to the node ND12. The gate of the first drive element N11 may be connected to the drain of the first drive element N11. Thus, the first drive element N11 may receive a voltage of the node ND11 through the gate thereof. The second drive element N12 may include an NMOS transistor. In an embodiment, a drain of the second drive element N12 may be connected to the node ND12. The source of the second drive element N12 may be connected to the ground voltage VSS terminal. The gate of the second drive element N12 may be connected to the node ND11. Thus, the second drive element N12 may receive the voltage of the node ND11 through the gate thereof. The second drive element N12 may be designed to have a threshold voltage which is higher than a threshold voltage of the first drive element N11. That is, the reference voltage generator 11 may generate the reference voltage signal VREF having a voltage level that is set under a condition that the reference current IREF is identical or substantially identical to a current flowing through the first and second drive elements N11 and N12 which are serially connected.

The output current generator 12 may include a third drive element N13. The third drive element N13 may be coupled between a node ND13 and the ground voltage VSS terminal. An output voltage signal VOUT may be induced at the node ND13. The third drive element N13 may include an NMOS transistor. In an embodiment, a drain of the third drive element N13 may be connected to the node ND13 and a source of the third drive element N13 may be connected to the ground voltage VSS terminal. A gate of the third drive element N13 may be connected to the node ND11. Thus, the third drive element N13 may receive the reference voltage signal VREF through the gate thereof. That is, the output current generator 12 may generate an output current IOUT whose level is controlled according to a voltage level of the reference voltage signal VREF.

The second drive element N12 of the reference voltage generator 11 and the third drive element N13 of the output current generator 12 may be designed to have the same or substantially the same transconductance characteristic (i.e., a drain current vs. a gate voltage characteristic) to constitute a current mirror circuit. Accordingly, if a drain voltage (i.e., a voltage of the node ND12) of the second drive element N12 is equal to or substantially equal to a voltage level (i.e., a voltage of the node ND13) of the output voltage signal VOUT, the output current IOUT may be generated to have the same or substantially the same level as the reference current IREF.

The internal circuit 20 may be driven by the power supply voltage VDD. The output current IOUT, used as an operation current of the internal circuit 20, may be controlled according to environmental conditions (e.g., the PVT conditions).

An operation of the semiconductor device having the aforementioned configurations will be described hereinafter with reference to FIG. 1 in conjunction with an example in which the reference current IREF increases according to varying PVT conditions. Additionally, an operation of the semiconductor device having the aforementioned configurations will be described hereinafter with reference to FIG. 1 in conjunction with an example in which the threshold voltages of the first to third drive elements N11, N12, and N13 are lowered according to varying PVT conditions.

First, the operation of the semiconductor device will be described hereinafter in conjunction with an example in which the reference current IREF increases according to varying PVT conditions.

The constant current source CS11 of the reference voltage generator 11 may supply the reference current IREF from the power supply voltage VDD terminal to the node ND11. The first and second drive elements N11 and N12 of the reference voltage generator 11 may generate the reference voltage signal VREF according to a current level of the reference current IREF. If the reference current IREF increases, a voltage drop across the first drive element N11 through which the reference current IREF flows may increase to reduce a drain to source voltage (Vds) of the second drive element N12.

The output current IOUT flowing through the third drive element N13 of the output current generator 12 may also increase to reduce a voltage level of the node ND13.

Accordingly, since a drain to source voltage (Vds) of the third drive element N13 may be set to be equal or substantially equal to a drain to source voltage (Vds) of the second drive element N12, the output current IOUT may be generated to have the same or substantially the same level as the reference current IREF.

The internal circuit 20 may be driven by the power supply voltage VDD. The output current IOUT, used as an operation current of the internal circuit 20, may be controlled according to environmental conditions (e.g., the PVT conditions).

Next, the operation of the semiconductor device will be described hereinafter in conjunction with an example in which the threshold voltages of the first to third drive elements N11, N12, and N13 are lowered according to varying PVT conditions.

The constant current source CS11 of the reference voltage generator 11 may supply the reference current IREF from the power supply voltage VDD terminal to the node ND11. Since the first drive element N11 of the reference voltage generator 11 is designed to have a threshold voltage which is lower than a threshold voltage of the second drive element N12 of the reference voltage generator 11, an on-resistance value of the first drive element N11 may be less than that of the second drive element N12. Thus, a drain to source voltage (Vds) of the first drive element N11 may be induced to be lower than that of the second drive element N12. That is, the drain to source voltage (Vds) of the second drive element N12 may increase as the drain to source voltage (Vds) of the first drive element N11 becomes reduced.

If the threshold voltage of the third drive element N13 of the output current generator 12 is lowered according to varying PVT conditions, a voltage level of the node ND13 may increase according to the output current IOUT.

Accordingly, since a drain to source voltage (Vds) of the third drive element N13 may be set to be equal or substantially equal to a drain to source voltage (Vds) of the second drive element N12, the output current IOUT may be generated to have the same or substantially the same level as the reference current IREF.

The internal circuit 20 may be driven by the power supply voltage VDD. The output current IOUT, used as an operation current of the internal circuit 20, may be controlled according to environmental conditions (e.g., the PVT conditions).

The semiconductor device having the aforementioned configuration may include drive elements having different threshold voltages to generate the output current IOUT having the same or substantially the same level as the reference current IREF even though the PVT conditions vary. Thus, malfunction of the semiconductor device may be prevented.

Figure 2:
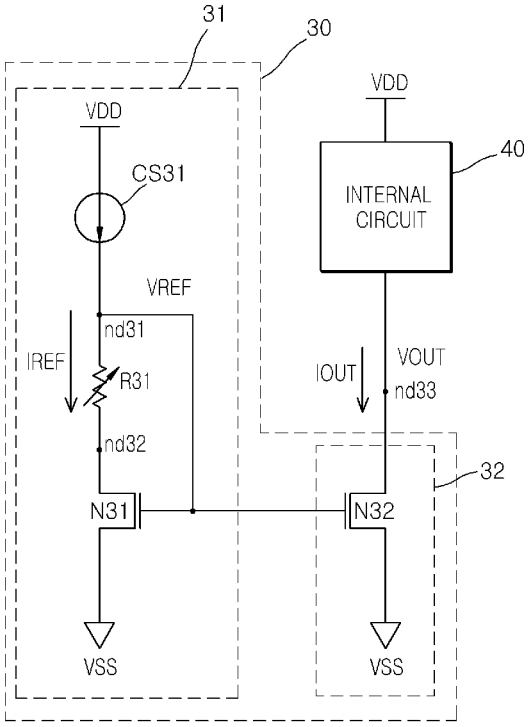
FIG. 2 is a schematic view illustrating a representation of a semiconductor device according to an embodiment.

Referring to FIG. 2, a semiconductor device according to an embodiment may be configured to include a current generation circuit 30 and an internal circuit 40.

The current generation circuit 30 may include a reference voltage generator 31 and an output current generator 32.

The reference voltage generator 31 may include a constant current source CS31. The constant current source CS31 may be coupled between a power supply voltage VDD terminal and a node ND31. A reference voltage signal VREF may be outputted through the node ND31. A resistive element R31 may be coupled between the node ND31 and a node ND32. The first drive element N31 may be coupled between the node ND32 and a ground voltage VSS terminal. The constant current source CS31 may supply a reference current IREF to the resistive element R31 through the node ND31. The resistive element R31 may include a variable resistor whose resistance value varies according to variations in the PVT conditions. The first drive element N31 may include an NMOS transistor. In an embodiment, a drain of the first drive element N31 may be connected to the node ND32. The source of the first drive element N31 may be connected to the ground voltage VSS terminal. The gate of the first drive element N31 may be connected to the node ND31. Thus, the first drive element N31 may receive the voltage of the node ND31 through the gate thereof. The first drive element N31 may be designed to have an on-resistance value which is greater than a resistance value of the resistive element R31. That is, the reference voltage generator 31 may generate the reference voltage signal VREF having a voltage level that is set under a condition that the reference current IREF is identical or substantially identical to a current flowing through the restive element RR31 and the first drive element N31 which are serially connected.

The output current generator 32 may include a second drive element N32. The second drive element N32 may be coupled between a node ND33 and the ground voltage VSS terminal. An output voltage signal VOUT may be induced at the node ND33. The second drive element N32 may include an NMOS transistor. In an embodiment, a drain of the second drive element N32 may be connected to the node ND33. The source of the second drive element N32 may be connected to the ground voltage VSS terminal. The gate of the second drive element N32 may be connected to the node ND31. Thus, the second drive element N32 may receive the reference voltage signal VREF through the gate thereof. That is, the output current generator 32 may generate an output current IOUT whose level is controlled according to a voltage level of the reference voltage signal VREF.

The first drive element N31 of the reference voltage generator 31 and the second drive element N32 of the output current generator 32 may be designed to have the same or substantially the same transconductance characteristic (i.e., a drain current vs. a gate voltage characteristic) to constitute a current mirror circuit. Accordingly, if a drain voltage (i.e., a voltage of the node ND32) of the first drive element N31 is equal to or substantially equal to a voltage level (i.e., a voltage of the node ND33) of the output voltage signal VOUT, the output current IOUT may be generated to have the same or substantially the same level as the reference current IREF.

The internal circuit 40 may be driven by the power supply voltage VDD. The output current IOUT, used as an operation current of the internal circuit 40, may be controlled according to environmental conditions (e.g., the PVT conditions).

An operation of the semiconductor device having the aforementioned configuration will be described hereinafter with reference to FIG. 2 in conjunction with an example in which the reference current IREF increases according to varying PVT conditions. Additionally, an operation of the semiconductor device having the aforementioned configuration will be described hereinafter with reference to FIG. 2 in conjunction with an example in which the threshold voltages of the first and second drive elements N31 and N32 are lowered according to varying PVT conditions.

First, the operation of the semiconductor device will be described hereinafter in conjunction with an example in which the reference current IREF increases according to varying PVT conditions.

The constant current source CS31 of the reference voltage generator 31 may supply the reference current IREF from the power supply voltage VDD terminal to the node ND31. The resistive element R31 and the first drive element N31 of the reference voltage generator 31 may generate the reference voltage signal VREF according to a current level of the reference current IREF. If the reference current IREF increases, a voltage drop across the resistive element R31 through which the reference current IREF flows may increase to reduce a drain to source voltage (Vds) of the first drive element N31.

The output current IOUT flowing through the second drive element N32 of the output current generator 32 may also increase to reduce a voltage level of the node ND33.

Accordingly, since a drain to source voltage (Vds) of the second drive element N32 may be set to be equal or substantially equal to a drain to source voltage (Vds) of the first drive element N31, the output current IOUT may be generated to have the same or substantially the same level as the reference current IREF.

The internal circuit 40 may be driven by the power supply voltage VDD. The output current IOUT, used as an operation current of the internal circuit 40, may be controlled according to environmental conditions (e.g., the PVT conditions).

Next, the operation of the semiconductor device will be described hereinafter in conjunction with an example in which the threshold voltages of the first and second drive elements N31 and N32 are lowered according to varying PVT conditions.

The constant current source CS31 of the reference voltage generator 31 may supply the reference current IREF from the power supply voltage VDD terminal to the node ND31. The first drive element N31 may be designed to have an on-resistance value which is greater than a resistance value of the resistive element R31. In an embodiment, if threshold voltages of the first and second drive elements N31 and N32 are lowered according to the PVT variation, on-resistance values of the first and second drive elements N31 and N32 and a resistance value of the resistive element R31 may be reduced. In such a cases, a decreasing rate of the resistance value of the resistive element R31 may be greater than a decreasing rate of the on-resistance values of the first and second drive elements N31 and N32. Thus, if the threshold voltages of the first and second drive elements N31 and N32 according to the PVT variation, a drain to source voltage (Vds) of the first drive element N31 may relatively increase. That is, if a voltage drop across the resistive element R31 decreases, the drain to source voltage (Vds) of the first drive element N31 may increase.

If the threshold voltage of the second drive element N32 of the output current generator 32 is lowered according to varying PVT conditions, a voltage level of the node ND33 may also increase according to the output current IOUT.

Accordingly, since a drain to source voltage (Vds) of the second drive element N32 may be set to be equal or substantially equal to a drain to source voltage (Vds) of the first drive element N31, the output current IOUT may be generated to have the same or substantially the same level as the reference current IREF.

The internal circuit 40 may be driven by the power supply voltage VDD. The output current IOUT, used as an operation current of the internal circuit 40, may be controlled according to environmental conditions (e.g., the PVT conditions).

The semiconductor device having the aforementioned configuration may generate the output current IOUT having the same or substantially the same level as the reference current IREF even though the PVT conditions vary. Thus, malfunction of the semiconductor device may be prevented.

Figure 3:
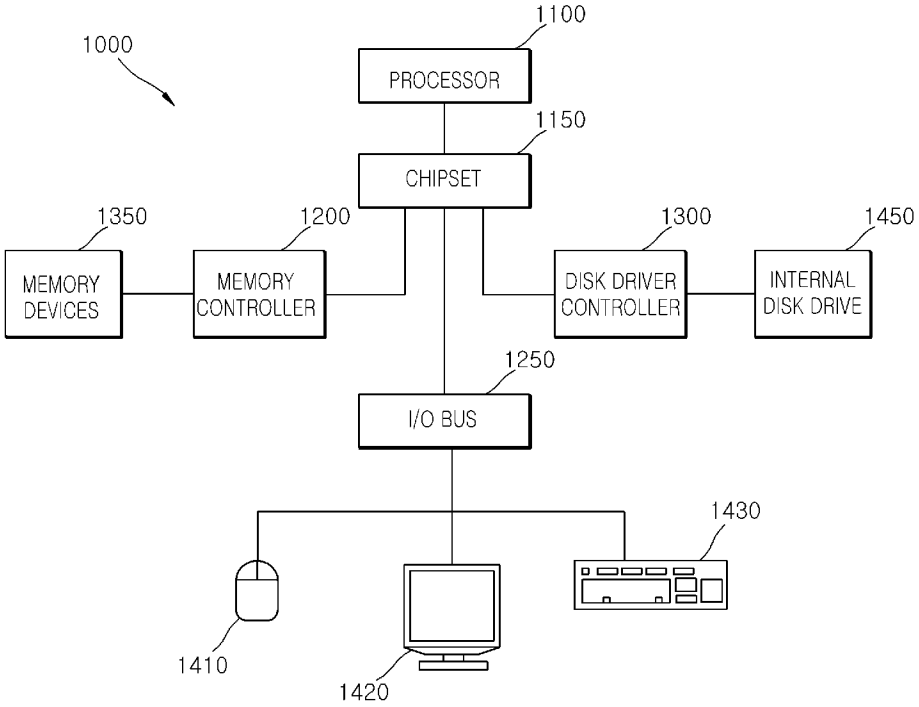
FIG. 3 illustrates a block diagram representation of an example of a system employing the semiconductor device in accordance with the embodiments discussed above with relation to FIGS. 1-2.

The semiconductor devices discussed above are particular useful in the design of memory devices, processors, and computer systems. For example, referring to FIG. 3, a block diagram of a system employing the semiconductor device in accordance with the embodiments are illustrated and generally designated by a reference numeral 1000. The system 1000 may include one or more processors or central processing units ("CPUs") 1100. The CPU 1100 may be used individually or in combination with other CPUs. While the CPU 1100 will be referred to primarily in the singular, it will be understood by those skilled in the art that a system with any number of physical or logical CPUs may be implemented.

A chipset 1150 may be operably coupled to the CPU 1100. The chipset 1150 is a communication pathway for signals between the CPU 1100 and other components of the system 1000, which may include a memory controller 1200, an input/output ("I/O") bus 1250, and a disk drive controller 1300. Depending on the configuration of the system, any one of a number of different signals may be transmitted through the chipset 1150, and those skilled in the art will appreciate that the routing of the signals throughout the system 1000 can be readily adjusted without changing the underlying nature of the system.

As stated above, the memory controller 1200 may be operably coupled to the chipset 1150. The memory controller 1200 may include at least one semiconductor device as discussed above with reference to FIGS. 1-2. Thus, the memory controller 1200 can receive a request provided from the CPU 1100, through the chipset 1150. In alternate embodiments, the memory controller 1200 may be integrated into the chipset 1150. The memory controller 1200 may be operably coupled to one or more memory devices 1350. In an embodiment, the memory devices 1350 may include the semiconductor device as discussed above with relation to FIGS. 1-2, the memory devices 1350 may include a plurality of word lines and a plurality of bit lines for defining a plurality of memory cell. The memory devices 1350 may be any one of a number of industry standard memory types, including but not limited to, single inline memory modules ("SIMMs") and dual inline memory modules ("DIMMs"). Further, the memory devices 1350 may facilitate the safe removal of the external data storage devices by storing both instructions and data.

The chipset 1150 may also be coupled to the I/O bus 1250. The I/O bus 1250 may serve as a communication pathway for signals from the chipset 1150 to I/O devices 1410, 1420 and 1430. The I/O devices 1410, 1420 and 1430 may include a mouse 1410, a video display 1420, or a keyboard 1430. The I/O bus 1250 may employ any one of a number of communications protocols to communicate with the I/O devices 1410, 1420, and 1430. Further, the I/O bus 1250 may be integrated into the chipset 1150.

The disk drive controller 1450 (i.e., internal disk drive) may also be operably coupled to the chipset 1150. The disk drive controller 1450 may serve as the communication pathway between the chipset 1150 and one or more internal disk drives 1450. The internal disk drive 1450 may facilitate disconnection of the external data storage devices by storing both instructions and data. The disk drive controller 1300 and the internal disk drives 1450 may communicate with each other or with the chipset 1150 using virtually any type of communication protocol, including all of those mentioned above with regard to the I/O bus 1250.

It is important to note that the system 1000 described above in relation to FIG. 3 is merely one example of a system employing the semiconductor device as discussed above with relation to FIGS. 1-2. In alternate embodiments, such as cellular phones or digital cameras, the components may differ from the embodiments illustrated in FIG. 3.

What is claimed is:

1. A current generation circuit comprising:

a reference voltage generator including a first drive element and a second drive element which are connected in series, and the reference voltage generator is suitable for generating a reference voltage signal; and an output current generator including a third drive element, and the output current generator suitable for generating an output current, wherein a voltage level of the reference voltage signal is set by a reference current, the reference current being substantially identical to a current flowing through the first and second drive elements, wherein a current level of the output current is set in response to the reference voltage signal, wherein a threshold voltage of the first drive element is different from a threshold voltage of the second drive element, wherein the first and second drive elements are a transistor, wherein the threshold voltage of the second drive element is configured to be higher than the threshold voltage of the first drive element, wherein the current generation circuit is realized by the first drive element, the second drive element and the third drive element, wherein the first drive element is coupled between a first node and a second node, wherein the second drive element is coupled between the second node and a ground voltage terminal, and wherein the third drive element is coupled between a third node and the ground voltage terminal.

2. The current generation circuit of claim 1, wherein the first node is configured to output the reference voltage signal;

wherein a gate of the first drive element is connected to the first node; and wherein a gate of the second drive element is connected to the first node.

3. The current generation circuit of claim 2, wherein the reference voltage generator further includes:

a constant current source coupled between a power supply voltage terminal and the first node, and the constant current source is configured to supply the reference current to the first node.

4. The current generation circuit of claim 3, wherein a voltage level of the reference voltage signal corresponds to a voltage drop across the first and second drive elements; and wherein the reference current is configured to flow through the first and second drive elements.

5. The current generation circuit of claim 1, wherein the output current generator is configured to generate the output current according to a voltage level of the reference voltage signal.

6. A semiconductor device comprising:

a current generation circuit including a first drive element and a second drive element which are connected in series, and the current generation circuit including a third drive element, and the current generation circuit is suitable for generating a reference voltage signal; and an internal circuit suitable for utilizing an output current, wherein a voltage level of the reference voltage signal is set by a reference current, the reference current being substantially identical to a current flowing through the first and second drive elements, wherein the output current of the internal circuit is controlled according to the reference current as an operation current thereof, wherein a threshold voltage of the first drive element is different from a threshold voltage of the second drive element, wherein the first and second drive elements are a transistor, wherein the threshold voltage of the second drive element is configured to be higher than the threshold voltage of the first drive element, wherein the current generation circuit is realized by the first drive element, the second drive element and the third drive element, wherein the first drive element is coupled between a first node and a second node, wherein the second drive element is coupled between the second node and a ground voltage terminal, and wherein the third drive element is coupled between a third node and the ground voltage terminal.

7. The semiconductor device of claim 6, wherein the current generation circuit includes:

a reference voltage generator including the first and second drive elements, and suitable for generating the reference voltage signal; and an output current generator including a third drive element, and the output current generator suitable for generating the output current, wherein the output current level of the output current generator is set in response to the reference voltage signal.

8. The semiconductor device of claim 7, wherein the first node is configured to output the reference voltage signal;

wherein a gate of the first drive element is connected to the first node; and wherein a gate of the second drive element is connected to the first node.

9. The semiconductor device of claim 8, wherein the reference voltage generator further includes:

a constant current source coupled between a power supply voltage terminal and the first node, and the constant current source is configured to supply the reference current to the first node.

10. The semiconductor device of claim 9, wherein a voltage level of the reference voltage signal corresponds to a voltage drop across the first and second drive elements; and wherein the reference current is configured to flow through the first and second drive elements.

11. The semiconductor device of claim 7, wherein the output current generator is configured to generate the output current according to a voltage level of the reference voltage signal.

* * * * *